US006160895A

United States Patent [19]

Dupont

[11] Patent Number: 6,160,895

[45] Date of Patent: Dec. 12, 2000

[54] HEARING AID SYSTEM WITH ACOUSTICAL HORN

[76] Inventor: Stephen Dupont, 24 N. Casey Key Rd., Osprey, Fla. 34229

[21] Appl. No.: 09/047,420

[22] Filed: Mar. 25, 1998

Related U.S. Application Data

[60] Provisional application No. 60/042,105, Mar. 26, 1997.

[51] Int. Cl.[7] ..... H04R 25/00

[52] U.S. Cl. ..... 381/330; 381/23.1; 381/322; 381/324; 381/328; 181/22

[58] Field of Search ..... 381/23.1, 322, 381/324, 328, 327, 330, 381, 382, 337, 338, 339, 340, 344; 181/20, 21, 22, 128; 379/430

[56] References Cited

U.S. PATENT DOCUMENTS

| | | | |
|---|---|---|---|
| 450,358 | 4/1891 | Marcus | 381/338 |
| 1,339,518 | 5/1920 | Krueger . | |
| 3,045,073 | 7/1962 | Vickerson | 179/107 |
| 3,201,528 | 8/1965 | Johanson et al. | 179/107 |
| 3,243,525 | 3/1966 | Eaton | 179/107 |
| 3,388,767 | 6/1968 | Wilson | 181/31 |
| 3,909,556 | 9/1975 | Johanson | 179/107 |
| 3,946,168 | 3/1976 | Preves | 179/107 |
| 3,975,599 | 8/1976 | Johanson | 179/107 |
| 4,041,251 | 8/1977 | Kaanders | 179/107 |
| 4,051,330 | 9/1977 | Cole | 179/107 |

*Primary Examiner*—Curtis A. Kuntz
*Assistant Examiner*—Suhan Ni
*Attorney, Agent, or Firm*—John R. Doherty

[57] ABSTRACT

A hearing aid system including an electronic hearing aid containing a microphone and having an orifice in one part thereof for transferring sound to the microphone and an acoustically amplifying horn formed with an outwardly flared end defining an inlet opening for sound originating ahead of the horn and an open downstream end attached to the part of the hearing aid containing the orifice such that the orifice is enclosed and sealed off from exposure to sound originating outside of the horn except for that sound entering the inlet opening.

21 Claims, 2 Drawing Sheets

HEARING AID SYSTEM WITH ACOUSTICAL HORN

This appln claims the benefit of U.S. Provisional No. 60/042,105 filed Mar. 26, 1997.

FIELD OF THE INVENTION

The present invention relates to electronic hearing aid devices and more particularly to a simple and inexpensive hearing aid system using an acoustical horn to achieve both directional and discriminatory hearing.

BACKGROUND OF THE INVENTION

The hearing aid industry has devoted considerable effort in recent years towards the development of new types of hearing aids which offer directional hearing to the hearing impaired or deaf. This feature is important since it enables hearing impaired persons to better locate sources of sound which may not be visible to them such as an unseen moving vehicle in the street. It is also important to have a hearing aid with good discriminatory hearing as well. This enables the hearing impaired person, among other things, to better identify and converse with people in crowded gatherings, for example.

These efforts by the hearing aid industry have produced improved hearing aid devices with special electronic circuitry and mechanical designs for providing both directional and discriminatory hearing. Unfortunately, these hearing aids are very complex and expensive and, in many cases, are financially beyond the reach of many hearing aid users.

SUMMARY OF THE INVENTION

The present invention is directed to an improved hearing aid system which effectively provides both directional and discriminatory hearing for the hearing impaired or deaf and which is simple and inexpensive.

The hearing aid system of the invention basically comprises the combination of an electronic hearing aid and an acoustically amplifying flared horn attached to the body of the hearing aid.

The hearing aid used in the hearing aid system of the invention may be any conventional electronic hearing aid which can be worn either behind the ear or within the ear and which has a microphone mounted internally within the hearing aid body. A small orifice is conventionally provided within a part of the hearing aid body, typically at the forward end of a behind-the-ear hearing aid, for transferring sound to the internal microphone.

The acoustically amplifying flared horn used in the hearing aid system of the invention may be made of most any material having fairly low acoustical properties, such as most elastomers and plastics, for example, and which can be easily shaped or molded into a desired configuration. The amplifying horn has a generally tubular shaped body formed with an outwardly flared end, defining an inlet opening for sound originating ahead of the horn. The tubular body further includes an open downstream end which is attached to the part of the hearing aid body containing the sound transferring orifice. The horn is attached to the hearing aid body in a manner whereby the orifice is enclosed and sealed off from exposure to sound originating from outside of the horn except that sound entering the inlet opening.

Thus, by this arrangement, any sound originating from behind or beside the hearing aid body is attenuated and reflected back by the flared inlet end of the horn while at the same time any sound entering the inlet opening from in front of the horn is significantly amplified by acoustical means. This feature gives to the deaf or hearing impaired user an improved discretionary and directional hearing ability which is at least equivalent to state of the art electronic hearing aid devices equipped with special circuitry or mechanical designs for accomplishing these same purposes, all in a very simple and economical way.

In one embodiment of the invention, the acoustically amplifying horn is made of an elastomer, such as rubber, and has its downstream end fitting snugly around the upward, forward end of a conventional behind-the-ear hearing aid body, enclosing and sealing off to isolate the sound transferring orifice. The usual sound conducting tube for delivering the amplified signal from the hearing aid body to the molded ear piece, which is inserted inside the user's ear, extends outwardly through both the tubular body and the inlet opening of the horn.

In another embodiment of the invention, the acoustically amplifying horn is again made of an elastomer, such as rubber, and has its downstream end fitted snugly around an exposed part of an in-the-ear hearing aid body containing the sound transferring orifice.

BRIEF DESCRIPTION OF THE DRAWINGS

The invention will be more fully understood from the following detailed description taken in conjunction with the accompanying drawings in which.

DESCRIPTION OF THE PREFERRED EMBODIMENTS

Figure 1:
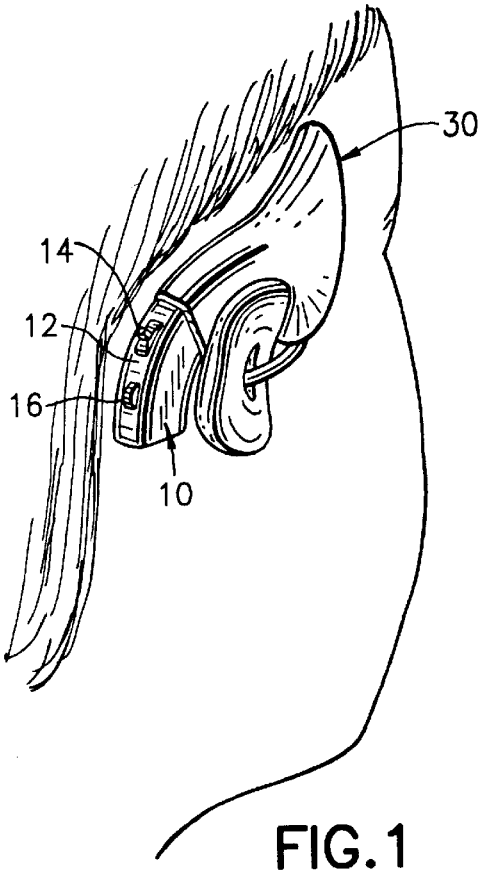
FIG. 1 is a perspective view of a behind-the-ear hearing aid system according to the invention.
Figure 3:
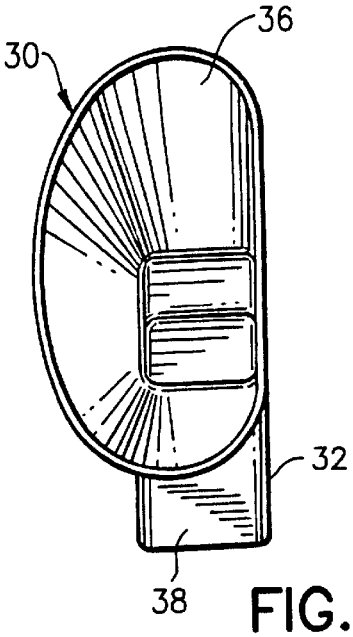
FIG. 3 is a frontal view of the acoustic horn used in the hearing aid system.

Referring now to the drawing, there is shown in FIGS. 1–5 a behind-the-ear hearing aid system according to the invention. The hearing aid system includes a conventional electronic hearing aid 10 having an outer body 12 suitably made of molded plastic material, for example. The body 12 is shaped in an arcuate fashion to fit snugly about the ear of the user as illustrated in FIG. 1.

The hearing aid body 12 includes the usual switch 14 for turning the unit "on" and "off" and a volume control 16. The hearing aid body 12 further includes a small orifice 18 within its upper forward end 20 for transferring sound to an internal microphone 22, which shown in phantom lines in FIG. 4.

A molded ear piece or insert 24 is placed inside the user's ear as generally depicted in FIG. 1. The insert 24 is fed with amplified sound signals from the hearing aid body 12 through a thin, flexible, sound-conducting tube 26. The tube 26 is affixed to an external fitting 28 on the forward end 20 of the body 12.

Figure 4:
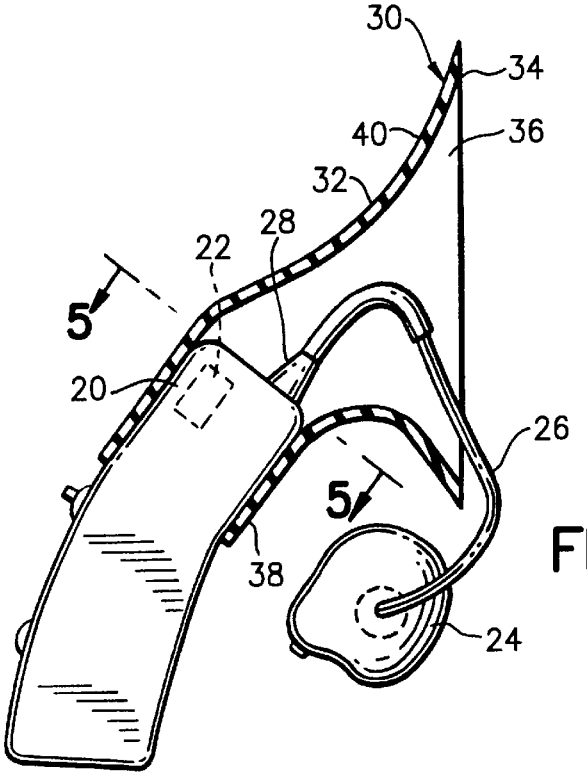
FIG. 4 is a side elevational view, partially in section, of the behind-the-ear hearing aid system shown in FIG. 1.
Figure 2:
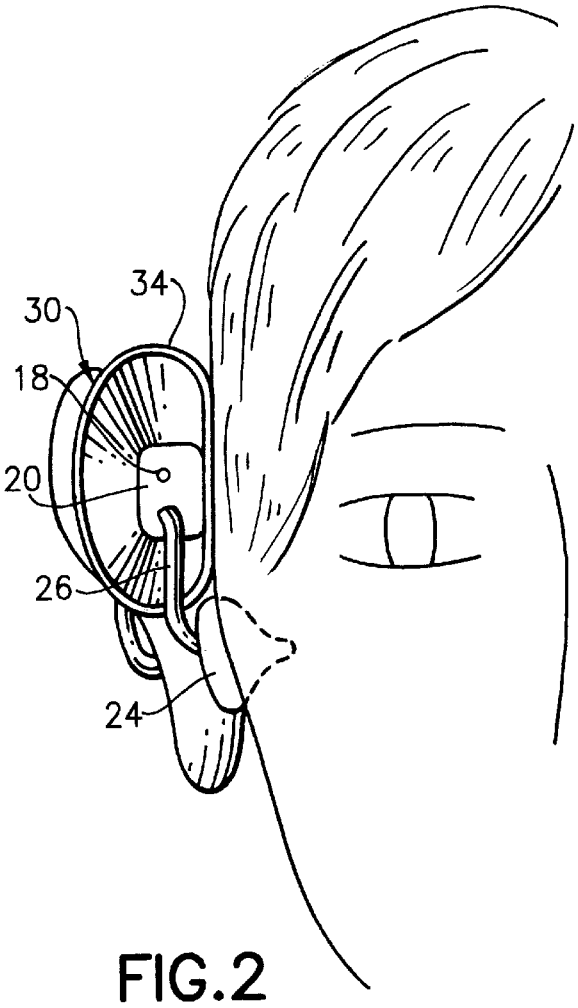
FIG. 2 is a perspective, frontal view of the hearing aid system shown in FIG. 1.
Figure 5:
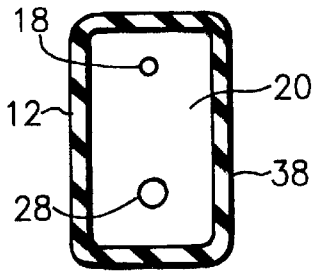
FIG. 5 is a sectional view taken along the lines 5–5 in FIG. 4.

An acoustically amplifying flared horn 30 is attached to the forward end 20 of the hearing aid body 12 as best illustrated in FIGS. 1 and 4. The amplifying horn 30 has a generally rectangular or oval tubular body 32 which is molded in one-piece from an elastomeric material, such as rubber, for example. The tubular body 32 is flared outwardly at its forward end 34, defining a generally oval shaped inlet opening 36. However, as seen particularly in FIG. 3, the inner side of the tubular body 32 is made straight in order to lie flush against the user's head.

The downstream end 38 of the acoustic horn 30 fits snugly around the upper forward end 20 of the hearing aid body 12, enclosing and sealing off the sound transmitting orifice 18. It will be seen that since the tubular body 34 of the horn 30 is elastic and stretchable, the downstream end 38 can be easily stretched and expanded to fit over the forward end 20, thereby achieving the snug fit between the horn 30 and hearing aid body 12.

The forward end 34 of the tubular body 32 is flared outwardly in a substantially parabolic fashion in order to achieve the acoustic properties required for amplification of the sound entering the horn. The flared edges surrounding the forward end 34 of the horn actually form a peripheral rim, depicted generally at 40, which effectively acts as a shield or reflector for attenuating sound originating from behind or to the side of the horn. Since the orifice 18 is sealed off and isolated by the downstream end 38 of the horn, the sound transmitted through the orifice to the microphone 22 is essentially only the sound from in front of the user.

The acoustic horn 30 should be made or constructed of sufficient length that when the hearing aid system is placed behind the user's ear as herein above described, the inlet opening 36 is actually positioned in front of the ear or ear piece 24 as clearly shown in FIG. 4. This is quite important for proper positioning of the horn to achieve optimum directional and discretionary hearing.

Figure 6:
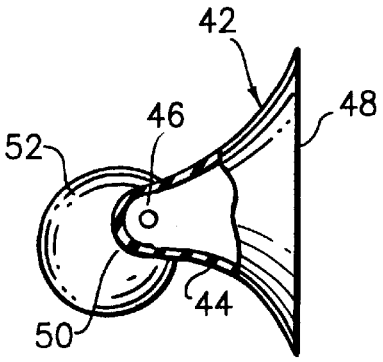
FIG. 6 is a side elevational view, partially in section, of an in-the-ear hearing aid system according to the invention.
Figure 7:
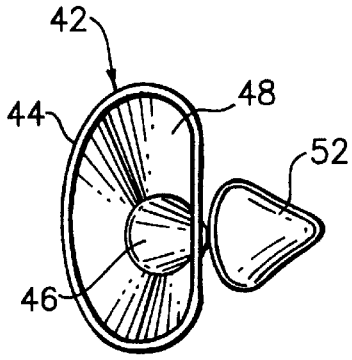
FIG. 7 is a front elevational view of the in-the-ear hearing aid system shown in FIG. 6.

FIGS. 6 and 7 illustrate an in-the-ear version of a hearing aid system according to the invention. This hearing aid system is basically the same as that described herein above, except that the acoustic horn 42 has an arcuately shaped tubular body 44 with a downstream end 46 that is disposed at an angle with respect to the inlet opening 48.

The tubular body 44 is again made from an elastomeric material, such as a rubber. Thus, the downstream end 46 can be stretched and expanded to fit snugly over an exposed part 50 of the ear insert 52. The ear insert 52 is similar to that used in the behind-the-ear version of the hearing aid system described above, except that in this case all the electronic components are contained within the ear piece itself and there is no need for a sound conducting tube.

In a series of test conducted using a behind-the-ear hearing aid system essentially the same as that illustrated in FIGS. 1–5, a set of three different tones were recorded and played by a cassette player, namely, the click of a metronome sounding the highest "A" note on the piano which is 3520 Hertz, the buzz of a kitchen oven timer falling between middle "C" (about 260 Hertz) and intermediate "A" (about 440 Hertz) and the telephone dial sounding about two octaves below "A" or about 100 Hertz. The sound or tones could be heard by a hearing impaired person wearing the behind-the-ear hearing aid system of the invention at the threshold of hearing half again as far away from the source facing the source as with the user's back to the source.

In other test using the same behind-the-ear hearing aid system of the invention, the user's ability to pick out and identify specific persons talking in a crowded area was significantly better with the acoustic horn in place than when wearing the hearing aid without the horn.

From the above, it will be seen that the invention provides a simple and inexpensive hearing aid system using an amplifying acoustical horn that fits easily and snugly to the body of a conventional hearing aid device. The acoustical horn can be used with hearing aids already in use by thousands of users and with most all of the hearing aid devices being sold today. The hearing aid system offers basically the same improvements provided by more expensive electronic hearing aid devices presently being sold on the market and at a very nominal cost. No hearing aid professional is required to install the system and the acoustical horns can be sold in packets in drugstores and other convenience stores. Although the hearing aid system may appear to be somewhat unusual at first glance, by continued use the system becomes as acceptable as glasses, ear rings and hearing aids themselves. They can of course be made quite ornamental as glasses are today.

What is claimed is:

1. A hearing aid system comprising, in combination, an electronic hearing aid, said hearing aid including an outer body containing a microphone, said outer body having an orifice in one part thereof for transferring sound to said microphone; and an acoustically amplifying horn, said amplifying horn having a tubular body formed with an outwardly flared end defining an inlet opening for sound originating ahead of said horn, said tubular body further including an open end located downstream from said inlet opening, said open end being attached to said part of said hearing aid body containing said orifice in a manner whereby said orifice is enclosed and sealed off from exposure to sound originating outside of said horn except for that sound entering said inlet opening.

2. A hearing aid system according to claim 1, wherein said outer body of said hearing aid is contoured to fit behind the ear of the user.

3. A hearing aid system according to claim 2, further including a molded ear insert and a hollow tube for transmitting amplified sound from said hearing aid body to said molded insert.

4. A hearing aid system according to claim 3, wherein said hollow tube extends outwardly through said tubular body and said inlet opening of said horn.

5. A hearing aid system according to claim 4, wherein the length of said tubular body is such that said inlet opening defined by said outwardly flared end is positioned substantially ahead of said ear insert when placed in the user's ear.

6. A hearing aid system according to claim 5, wherein said tubular body is substantially rectangular or oval shaped and wherein said outwardly flared forward end is substantially parabolic.

7. A hearing aid system according to claim 6, wherein said inlet opening is substantially oval in shape and substantially larger in cross-section than said tubular body.

8. A hearing aid system according to claim 7, wherein said acoustical horn is made of an elastomer material.

9. A hearing aid system according to claim 8, wherein one side of said tubular body at said forward end thereof is straight so as to fit snugly against the user's head when placed behind the user's ear.

10. A hearing aid system according to claim 1, wherein said outer body of said hearing aid is contoured to fit inside the ear of the user.

11. A hearing aid system according to claim 10, wherein said outer body has an exposed part containing an orifice for transferring sound to said microphone, said amplifying horn being attached to said exposed part of said outer body.

12. A hearing aid system according to claim 11, wherein amplifying horn is arcuately shaped such that said downstream end is disposed at an angle with respect to said flared end and said inlet opening.

13. A hearing aid system according to claim 12, wherein said amplifying horn is made of an elastomer material.

14. An acoustical horn for attachment to the forward end of a hearing aid device containing a sound transferring orifice, said horn comprising a tubular body having an outwardly flared forward end, defining an inlet opening for sound originating ahead of said horn and a downstream open end which is stretchable and can be expanded to fit snugly over said forward end of said hearing aid containing said orifice.

15. An acoustical horn according to claim 14, wherein said tubular body is made of an elastomer material.

16. An acoustical horn according to claim 14, wherein said tubular body is substantially rectangular or oval shaped and wherein said outwardly flared forward end is substantially parabolic.

17. An acoustical horn according to claim 16, wherein said inlet opening is substantially oval in shape and substantially larger in cross-section than said tubular body.

18. An acoustical horn according to claim 17, wherein one side of said tubular body at said forward end thereof is straight so as to fit snugly against the user's head when placed behind the user's ear.

19. An acoustical horn according to claim 18, wherein said tubular body is made of such length that when attached to said forward end of said hearing aid said outwardly flared forward end of said body is positioned substantially ahead of the user's ear.

20. An acoustical horn for attachment to the forward end of a hearing aid device containing a sound transferring orifice, said horn comprising a tubular body made from an elastomeric material, said tubular body being substantially rectangular or oval shaped and having an outwardly flared substantially parabolic forward end, defining an oval shaped inlet opening for sound originating ahead of said horn, said inlet opening being straight on one side thereof so as to fit snugly behind the user's ear and a downstream open end which is stretchable and can be expanded to fit snugly over said forward end of said hearing aid containing said orifice.

21. A hearing aid system comprising, in combination:

an electronic hearing aid including an outer body containing a microphone, said outer body having at one end thereof an orifice for transferring sound to said microphone, a molded ear insert and a hollow tube for transmitting amplified sound from said hearing aid to said molded insert; and an acoustically amplifying horn having a tubular body made from an elastomer material, said tubular body having an outwardly flared, substantially parabolically shaped forward end, defining an inlet opening for sound originating ahead of said horn and a downstream open end which fits snugly over said end of said tubular body for attachment to said hearing aid, said hollow tube extending outwardly through said inlet opening to said molded ear insert.

* * * * *